US009150016B2

(12) United States Patent
Otaka et al.

(10) Patent No.: US 9,150,016 B2
(45) Date of Patent: Oct. 6, 2015

(54) METHOD OF MANUFACTURING LIQUID EJECTION HEAD

(71) Applicant: CANON KABUSHIKI KAISHA, Tokyo (JP)

(72) Inventors: Shimpei Otaka, Kawasaki (JP); Takayuki Ono, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 179 days.

(21) Appl. No.: 13/706,513

(22) Filed: Dec. 6, 2012

(65) Prior Publication Data

US 2013/0155151 A1 Jun. 20, 2013

(30) Foreign Application Priority Data

Dec. 15, 2011 (JP) ..... 2011-274412

(51) Int. Cl.
*B41J 2/14* (2006.01)
*B41J 2/015* (2006.01)
*B41J 2/16* (2006.01)

(52) U.S. Cl.
CPC ..... *B41J 2/14072* (2013.01); *B41J 2/16* (2013.01); *B41J 2/1623* (2013.01); *B41J 2202/19* (2013.01); *B41J 2202/20* (2013.01); *Y10T 428/24273* (2015.01)

(58) Field of Classification Search
CPC ..... B41J 2/1623; B41J 2/1607; B41J 2/16
USPC ..... 347/47, 50
See application file for complete search history.

(56) References Cited

U.S. PATENT DOCUMENTS

| | | | | |
|---|---|---|---|---|
| 5,888,333 | A | 3/1999 | Ono et al. | |
| 5,933,163 | A | 8/1999 | Koizumi et al. | |
| 6,183,064 | B1 * | 2/2001 | Murthy et al. | 347/47 |
| 6,569,343 | B1 * | 5/2003 | Suzuki et al. | 216/27 |
| 6,825,910 | B2 | 11/2004 | Aoki et al. | |
| 7,152,952 | B2 * | 12/2006 | Chikamoto | 347/47 |
| 7,332,209 | B2 * | 2/2008 | Yokouchi et al. | 428/166 |
| 7,625,076 | B2 * | 12/2009 | Ito | 347/72 |
| 7,669,982 | B2 * | 3/2010 | Ito | 347/68 |
| 8,210,647 | B2 | 7/2012 | Shimazu et al. | |
| 2002/0036678 | A1 * | 3/2002 | Ito et al. | 347/71 |
| 2004/0087063 | A1 * | 5/2004 | Akhavin et al. | 438/127 |
| 2007/0008375 | A1 * | 1/2007 | Tanikawa et al. | 347/47 |
| 2009/0169795 | A1 * | 7/2009 | Fiechter | 428/41.8 |
| 2009/0193658 | A1 * | 8/2009 | Watanabe | 29/890.1 |

FOREIGN PATENT DOCUMENTS

| | | | |
|---|---|---|---|
| JP | 2002-131764 | A | 5/2002 |
| JP | 2005-116917 | A | 4/2005 |

* cited by examiner

*Primary Examiner* — Matthew Luu
*Assistant Examiner* — Patrick King
(74) *Attorney, Agent, or Firm* — Fitzpatrick, Cella, Harper & Scinto

(57) ABSTRACT

A support substrate and a liquid ejecting element substrate are bonded to each other with an adhesive agent to manufacture a liquid ejection head. The support substrate is provided with a liquid supply port and a recess or through-hole in its main surface. The adhesive agent is applied onto the main surface of the support substrate by means of a roller holding the adhesive agent on its peripheral surface by moving the support substrate and the roller relative to each other such that the recess or through-hole faces the roller before the liquid supply port faces the roller.

4 Claims, 4 Drawing Sheets

METHOD OF MANUFACTURING LIQUID EJECTION HEAD

BACKGROUND OF THE INVENTION

1. Field of the Invention

The present invention relates to a method of manufacturing a liquid ejection head for ejecting liquid such as ink.

2. Description of the Related Art

Various techniques are being employed in the field of electronic packaging for the purpose of applying liquid such as an adhesive agent or an encapsulant material to the surface of a substrate to which an IC (integral circuit) chip or a wiring substrate is to be bonded. Known such techniques include, for example, a technique of applying liquid in a lump to a substrate with use of a transfer plate and a technique of ejecting liquid through a thin needle fitted to a syringe that is filled with liquid for painting application.

Meanwhile, there is another known technique of applying liquid to a substrate by squeegeeing liquid onto a rotating roller to a desired thickness in advance and transferring the liquid onto the substrate while driving the roller to touch and traverse the substrate. Such liquid transfer using a roller is being widely employed in the field of printing. For example, ink is laid on an offset roller to a desired thickness and a sheet of paper is pressed against the roller for ink transfer in an offset printing operation. Such a technique of transferring liquid by means of a roller can be used to apply liquid onto a substrate to a desired thickness so as to achieve an excellently uniform distribution of thickness if the thickness of the liquid on the roller is controlled. Additionally, the technique of transferring liquid by means of a roller can reduce the time required to apply liquid and hence can apply liquid in a lump for a uniform distribution of thickness in a short period of time. Thus, this technique of transferring liquid by means of a roller has a wide range of potential applications of applying liquid such as an adhesive agent or an encapsulant material to the surface of a substrate in the field of electronic packaging.

In the field of electronic packaging, for instance, Japanese Patent Application Laid-Open No. 2002-131764 discloses a method of applying an encapsulant material to a substrate and Japanese Patent Application Laid-Open No. 2005-116917 discloses a method of using a roller to apply molten solder to a substrate as transfer and application techniques using a roller.

As described above, liquid can be applied uniformly and relatively easily onto the entire surface of a substrate by using such a technique of transferring and applying liquid onto a substrate by means of a roller. For example, an adhesive agent can efficiently be applied to a substrate by using such a technique of transferring and applying an adhesive agent onto a substrate by means of a roller.

However, there are instances where a substrate does not have a uniform and plane surface in the field of electronic packaging. For example, plate substrates to be used for liquid ejection heads are provided with a liquid supply port as an aperture for supplying ink to a recording element substrate arranged on the substrate surface. This liquid supply port is a through hole extending from the front surface to the rear surface of the plate substrate and takes an important role for supplying ink to a recording element substrate. Then, as an adhesive agent, for example, for bonding a recording element substrate to the plate substrate is transferred and applied to the latter by means of a roller, the adhesive agent can get into the liquid supply port depending on the physical properties of the adhesive agent.

As the adhesive agent gets into the liquid supply port, the adhesive agent closes part of the liquid supply port, which can change the flow rate of ink flowing through the liquid supply port. Particularly in the case of a liquid ejection head that has a plurality of liquid supply ports, the size of the aperture of each of the liquid supply ports can be changed by the adhesive agent that has gotten into the liquid supply port, to by turn change the ink flow rate of each of the recording element substrates to consequently give rise to a problem to the printing performance of the liquid ejection head.

Furthermore, when a liquid ejection head has small liquid supply ports, the adhesive agent that has gotten into the liquid supply ports can completely clog them.

SUMMARY OF THE INVENTION

The present invention is to solve the problem that, when liquid is transferred and applied to the plate substrate of a liquid ejection head, the liquid can get into the liquid supply port that is an aperture arranged at the surface of the plate substrate to change the size of or clog the liquid supply port.

According to the present invention, the above problem is solved by providing a method of manufacturing a liquid ejection head including: a step of bringing in a plate substrate having a surface provided with an aperture for supplying liquid and a recess or through hole; and a step of rotating a roller holding an adhesive agent on the surface thereof and transferring the adhesive agent onto the surface of the plate substrate; the recess or the through hole and the aperture being arranged in the above order as viewed in the transfer direction.

According to the present invention, there is also provided a method of manufacturing a liquid ejection head including: a step of bringing in a support substrate provided with a liquid supply port for supplying liquid and a recess or through hole on the main surface thereof; a step of transferring an adhesive agent on the main surface by moving the support substrate and a roller relative to each other so as to make the recess or the through hole and the liquid supply port sequentially face the roller in the above order; and a step of bonding the support substrate and a recording element substrate having an element for generating energy for ejecting liquid by means of the adhesive agent.

Further features of the present invention will become apparent from the following description of exemplary embodiments with reference to the attached drawings.

DESCRIPTION OF THE EMBODIMENTS

Now, embodiments of the present invention will be described in greater detail by referring to the accompanying drawings. In the accompanying drawings, the components having the same functions are denoted by the same reference numbers and will not be described repeatedly.

Figure 1:
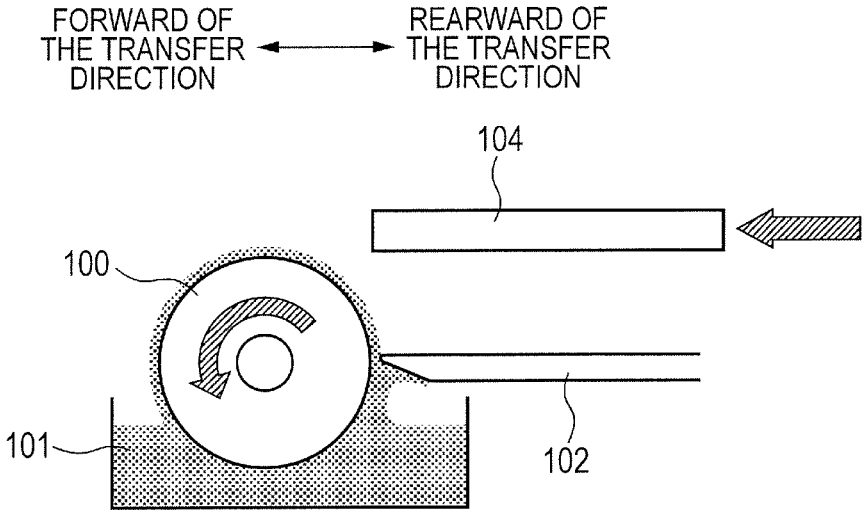
FIG. 1 is a schematic illustration of an apparatus for transferring liquid onto a substrate by means of a roller.

FIG. 1 is a schematic illustration of an apparatus for transferring liquid onto a substrate by means of a roller. A roller 100 is immersed in the liquid to be transferred onto a plate substrate 104. For this embodiment, an adhesive agent 101 for bonding recording element substrates and a wiring substrate, which will be described hereinafter, to the plate substrate 104 is employed as the liquid. The roller 100 has a rolling mechanism (not illustrated) and can be driven to rotate at any rotational speed. A squeegee 102 is arranged near the roller 100 in order to control the thickness of the adhesive agent 101 on the roller 100 to a constant thickness when the roller 100 is driven to rotate. The gap between the squeegee 102 and the roller 100 is adjustable and hence the thickness of the adhesive agent 101 on the roller 100 is controllable.

When transferring an adhesive agent 101 onto the plate substrate 104, the roller 100 is driven to rotate in a condition where the roller 100 is immersed in the adhesive agent 101 so as to make the adhesive agent 101 uniformly adhere to the entire peripheral surface of the roller 100. At this time, the excessive part, if any, of the adhesive agent 101 adhering to the roller 100 is removed by the squeegee 102 arranged near the roller 100.

Then, the plate substrate 104 having apertures on the surface where liquid is to be transferred is driven to move so as to cause the roller 100, to the peripheral surface of which the adhesive agent is made to adhere to a uniform thickness, to touch and traverse the plate substrate 104, while driving the roller 100 to rotate. In this way, the adhesive agent 101 is transferred onto the plate substrate 104. At this time, the thickness of the adhesive agent 101 to be transferred onto the plate substrate 104 can be controlled by adjusting the gap between the squeegee 102 and the roller 100.

Figure 2:
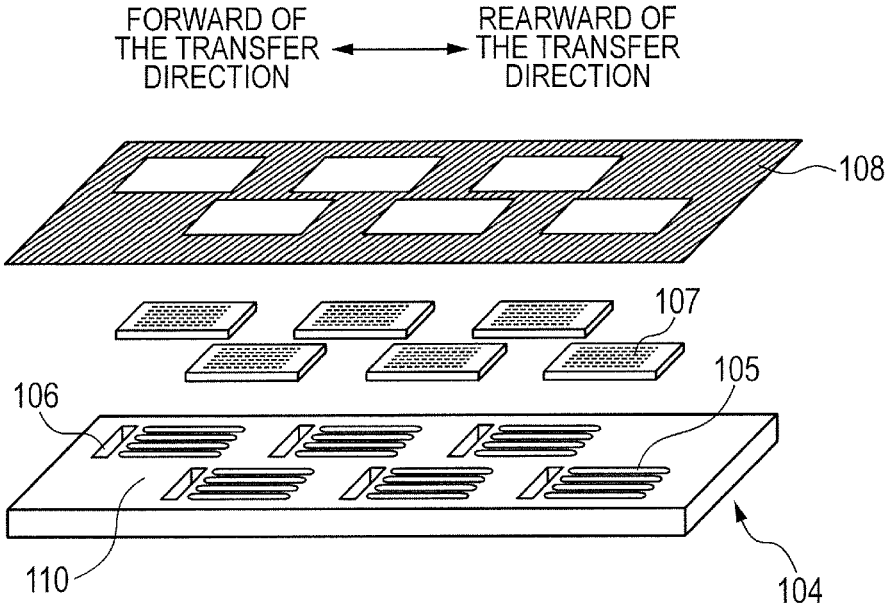
FIG. 2 is an exploded schematic perspective view of a liquid ejection head that includes the plate substrate that is used in Embodiment 1.

After transferring the adhesive agent 101 onto the plate substrate 104, a liquid ejection head is manufactured by bonding recording element substrates 107 having energy generating elements for causing ink to be ejected and a wiring substrate 108 to the plate substrate 104 as shown in FIG. 2.

With the embodiments, recesses 106 are formed on the flat surface section 110, which will be described hereinafter and onto which the adhesive agent 101 is to be transferred, of the plate substrate 104 having the apertures before transferring the liquid adhesive agent 101. These recesses can suppress the intrusion of the adhesive agent 101 into the apertures or control the amount of adhesive agent getting into the apertures. This will be described in greater detail below.

Embodiment 1

As illustrated in FIG. 2, recording element substrates 107 and a wiring substrate 108 are bonded to the plate substrate 104 with this embodiment. An epoxy-based liquid adhesive agent is employed for the adhesive agent 101 to be transferred.

The plate substrate 104 that is a support substrate for supporting the recording element substrates 107 is provided with a flat surface section 110 where recording element substrates 107 and a wiring substrate 108 are to be bonded and a plurality of liquid supply ports 105 that are apertures for supplying ink. These ink supply ports 105 are required to have a defined certain size in order to supply ink to the recording element substrates 107 at a desired rate. If the adhesive agent 101 gets into the liquid supply ports 105, while being transferred onto the plate substrate 104 by the roller 100, the liquid supply ports 105 may be clogged by the adhesive agent 101 so that ink may not flow at a desired rate. If the adhesive agent 101 that gets into the liquid supply ports 105 completely clogs the latter, no ink is supplied to the recording element substrates 107.

In view of the above-described problem, with this embodiment, as illustrated in FIG. 2, the plate substrate 104 is provided, on the flat surface section 110 thereof where the adhesive agent 101 is to be transferred with recesses 106 such that each of the recesses 106 is located at a position in front of a group of liquid supply ports 105 as viewed in the direction of liquid transfer so as to correspond to the group of liquid supply ports 105. The provision of the recesses 106 can suppress the intrusion of the adhesive agent 101 into the liquid supply ports 105 at the time of transferring the adhesive agent 101.

Figure 3A:
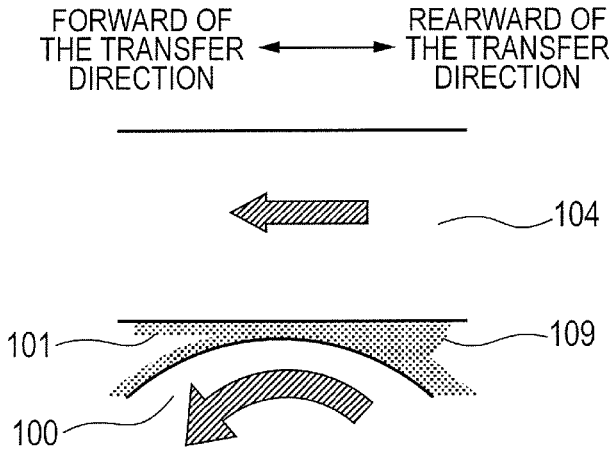
FIGS. 3A and 3B are schematic illustrations of the behavior of an adhesive agent when the adhesive agent is transferred.

This will be described in greater detail below. Firstly, the phenomenon where the adhesive agent 101 gets into the insides of the liquid supply ports 105 at the time of transfer will be described. The plate substrate 104 is made to touch the roller 100 when transferring the adhesive agent 101. Note, however, the plate substrate 104 does not completely touch the roller 100 in actuality. As seen from FIG. 3A illustrating a cross-sectional view of the plate substrate 104 and the roller 100 during an operation of transferring the adhesive agent 101, a small gap exists between the plate substrate 104 and the roller 100 and the gap is filled with the adhesive agent 101. In other words, the adhesive agent 101 is not completely crushed by the plate substrate 104, although the adhesive agent 101 on the roller 100 is crushed to a certain extent. As a result, the adhesive agent 101 is transferred onto the plate substrate 104, while keeping a defined certain thickness. As the adhesive agent 101 is transferred, while being crushed to a certain extent, a mass of adhesive agent 109 is produced between the roller 100 and the plate substrate 104 at the rearward of the transfer direction as illustrated in FIG. 3A. This mass of adhesive agent 109 grows as the operation of transferring the adhesive agent 101 onto the flat surface section 110 of the plate substrate 104 continues because the mass 109 cannot go anywhere else. Particularly, if groups of liquid supply ports 105 are arranged on the plate substrate 104 in a zigzag manner as illustrated in FIG. 2, the groups of liquid supply ports 105 are separated from one another by long intervals in the transfer direction and hence the adhesive agent 101 cannot help being transferred continuously onto the flat surface section 110. Then, the mass of adhesive agent 109 can grow further.

Figure 3B:
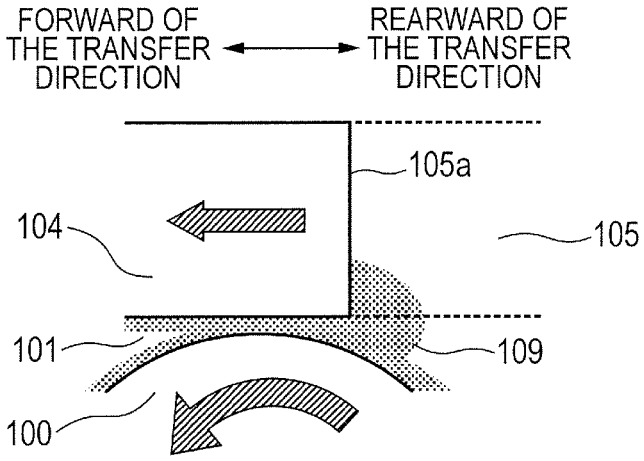

As the mass of adhesive agent 109 reaches a group of liquid supply ports 105 as illustrated in FIG. 3B, the mass of adhesive agent 109 contacts and adheres to the side walls 105*a* of the liquid supply ports 105 at the front sides thereof as viewed in the transfer direction. Thus, the adhesive agent 101 gets into the liquid supply ports 105. This phenomenon occurs when the roller 100 nearly reaches a group of liquid supply ports 105 from the flat surface section 110 of the plate substrate 104. To the contrary, no substantial intrusion of the adhesive agent 101 into a group of liquid supply ports 105 occurs when the roller 100 nearly reaches the flat surface section 110 of the plate substrate 104 from a group of liquid supply ports 105. This is because, when the roller 100 nearly reaches a group of liquid supply ports 105, the liquid supply ports 105 are open and hence the adhesive agent 101 is practically not crushed by the plate 104. Thus, no mass of adhesive agent 109 is produced at the rearward of the transfer direction. In other words, any mass of adhesive agent 109 substantially disappears because of the apertures, or the liquid supply ports 105.

Thus, the adhesive agent 101 gets into the liquid supply ports 105 for the above-described reason. To solve this problem, this embodiment is so configured as to be characterized in that the plate substrate 104 is provided on the flat surface section 110 thereof where the adhesive agent 101 is to be transferred with recesses 106 such that each of the recesses 106 is located at a position in front of a group of liquid supply ports 105 as viewed in the direction of transfer so as to correspond to the group of liquid supply ports 105. With this arrangement that characterizes this embodiment, a mass of adhesive agent 109 that is produced at the flat surface section 110 gets into the recess 106 arranged in front of a corresponding group of liquid supply ports 105 before the mass nearly reaches the liquid supply ports 105 and substantially disappears. Thus, the mass of adhesive agent 109 that reaches a group of liquid supply ports 105 as the roller 100 nearly reaches the group can be minimized and hence the intrusion of the adhesive agent 101 into the liquid supply ports 105 can be suppressed.

The width of the recesses 106 in the direction orthogonal to the transfer direction is preferably the same as or greater than the width of the groups of liquid supply ports 105 because a mass of adhesive agent 109 will be forced to disappear by a recess more reliably when the width of the recess is greater than the width of the corresponding group of liquid supply ports 105.

The depth of the recesses 106 from the surface of the plate substrate 104 to which the adhesive agent 101 is transferred is preferably greater than the thickness of the adhesive agent 101 that is made to adhere to the roller 100 and squeegeed by the squeegee 102. Alternatively, the recesses may be through holes cut through the plate substrate 104.

The recesses 106 may have any length in the direction parallel to the transfer direction so long as the recesses provide an effect of making any mass of adhesive agent 109 disappear. The number of recesses 106 is not subject to any limitations. In other words, recesses 106 may be arranged in any number.

With this embodiment, a wiring substrate 108 for the liquid ejection head is bonded to the flat surface section 110 of the plate substrate 104 by means of the adhesive agent 101. The wiring substrate 108 is provided with electric conduction pads (not illustrated) and the positions of the electric conduction pads desirably do not agree with the positions of any of the recesses 106 when the wiring substrate 108 is bonded to the flat surface section 110. The reason for this is that a wire bonding operation is conducted on the electric conduction pads of the wiring substrate 108 in order to establish electrical connection down to the recording element substrate 107 and a bonding tool needs to be stably brought into contact with the electric conduction pads during the bonding operation.

Figure 4A:
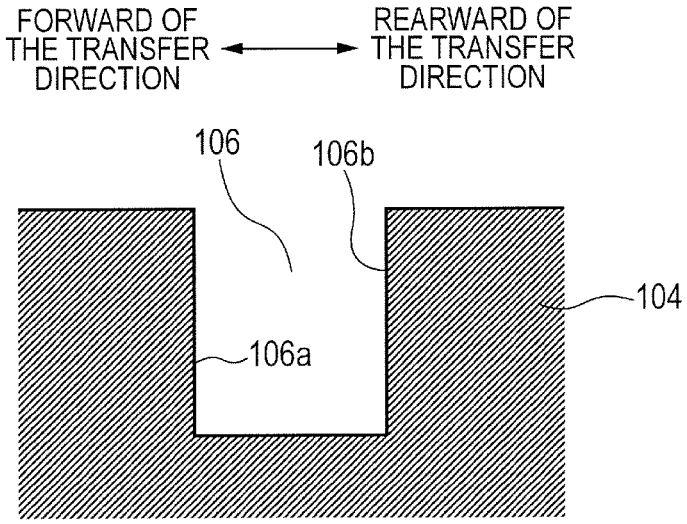
FIGS. 4A and 4B are schematic cross-sectional views of two alternative recesses.
Figure 4B:
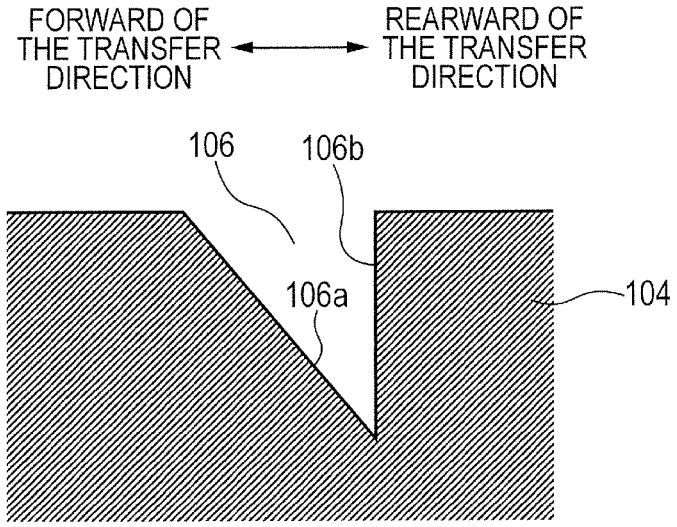

With regard to the profile of the recesses 106, the front and back side walls 106*a* and 106*b* of each recess 106 are desirably perpendicular to the transfer surface of the adhesive agent 101 on (the flat surface section 110 of) the plate substrate 104 as illustrated in the cross-sectional view of FIG. 4A. With this arrangement, the adhesive agent 101 that gets into the recesses 106 adheres to the front side walls 106*a* of the recesses 106 to give rise to an effect of boosting the adhesive force of the wiring substrate 108. This is because the shear adhesive force of the adhesive agent 101 at each of side walls 106*a* of the recesses 106 is added to the adhesive force of the wiring substrate 108.

If the adhesive agent 101 is of the ultraviolet curing type, an arrangement for irradiating UV rays to the adhesive agent 101 that has adhered to the side walls 106*a* of the recesses 106 or gotten into the recesses 106 has to be considered. For such an arrangement, the back side walls 106*b* of the recesses 106 as viewed in the transfer direction of the plate substrate 104 may be made perpendicular to the transfer surface of the adhesive agent 101 and the front side walls 106*a* of the recesses 106 as viewed in the transfer direction may be inclined relative to the respective side walls 106*b* so as to represent a certain angle to the transfer surface of the adhesive agent 101.

With the above-described arrangement, in the liquid ejection head formed by transferring the adhesive agent 101 to the plate substrate 104 prepared according to this embodiment and subsequently bonding the recording element substrate 107 and the wiring substrate 108 to the plate substrate 104, ink is supplied from the liquid supply ports 105 to the recording element substrates 107 at a desired flow rate. Thus, the liquid ejection head can maintain a good printing quality.

In an experiment, an adhesive agent 101 was transferred onto a plate substrate 104 prepared under the conditions described below. The recesses 106 had a depth of 1 mm and a length of 4 mm in the direction that runs parallel with the transfer direction. Then, a roller 100 carrying the adhesive agent 101 that was made to adhere thereto by means of a squeegee 102 to a thickness of 0.1 mm was driven to rotate and touch the plate substrate 104, while the plate substrate 104 was made to traverse the roller 100 so as to transfer the adhesive agent 101 to the plate substrate 104. After the transfer, the plate substrate 104 was observed to find that practically no adhesive agent 101 had gotten into the liquid supply ports 105 and hence the adhesive agent 101 had been transferred satisfactorily onto the plate substrate 104.

With this embodiment, recesses 106 are formed in front of the respective groups of liquid supply ports 105 at positions located close to the latter as viewed in the transfer direction. Then, as a result, the amount of adhesive agent 101 that gets into the inside of each of the liquid supply ports 105 can be minimized. The distance between each of the recesses 106 and the corresponding one of the groups of liquid supply ports 105 is preferably as small as possible from the viewpoint of minimizing the amount of adhesive agent that gets into the inside of each of the liquid supply ports 105. Apart from this, the distance between a group of liquid supply ports 105 to the recess 106 arranged in front of it is preferably smaller than the distance between the recess 106 and the group of liquid supply ports 105 arranged in front of the recess 106.

While the plate substrate 104 is driven to move relative to the roller 100 in the above-described embodiment, the present invention is by no means limited thereto. Alternatively, the roller 100 may be driven to move relative to the plate substrate 104 or both the roller 100 and the plate substrate 104 may be driven to move relative to each other. In short, what is required is that a relative movement of the roller 100 and the plate substrate 104 takes place and a recess or a through hole 106 and a group of liquid supply ports 105 of the plate substrate 104 sequentially come to face the roller.

Embodiment 2

Figure 5:
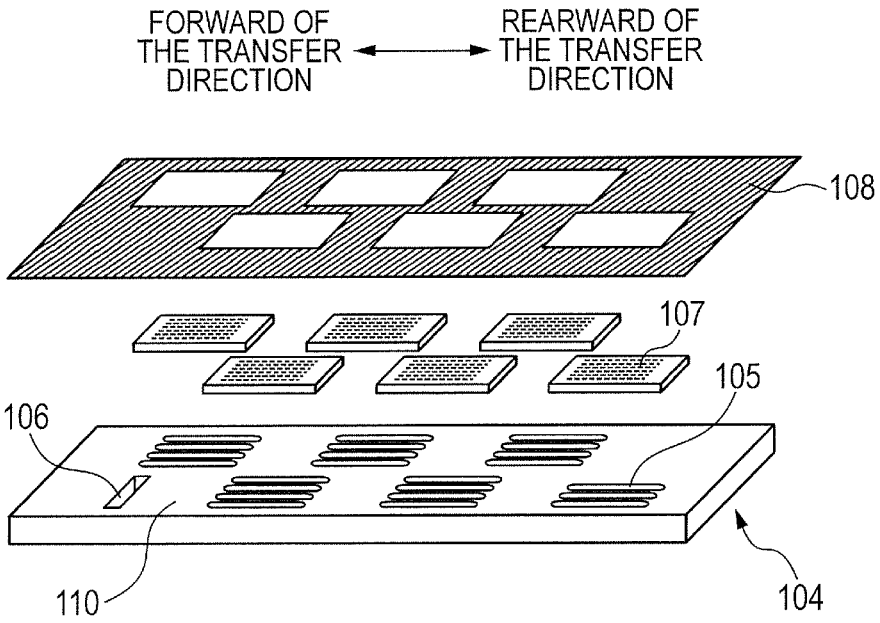
FIG. 5 is an exploded schematic perspective view of a liquid ejection head that includes the plate substrate that is used in Embodiment 2.

With this embodiment, a plate substrate 104 is provided with recesses 106 in the flat surface section 110 thereof with an aim of suppressing the variation in the quantity by which the adhesive agent 101 gets into the liquid supply ports 105. More specifically, as illustrated in FIG. 5, recesses 106 are formed so as to make the distance from each of the liquid supply ports 105 to the liquid supply port 105 or the recess immediately preceding it in the transfer direction is the same for all the liquid supply ports 105. With this arrangement, as the roller 100 gets to a liquid supply port 105, the mass of adhesive agent 109 described above is substantially the same for all the liquid supply ports 105.

In an experiment, an adhesive agent 101 was transferred onto a plate substrate 104 prepared with this embodiment as illustrated in FIG. 5. All the other conditions of the experiment were the same as those of the experiment described above for Embodiment 1. After the transfer operation, the liquid supply ports 105 of the plate substrate 104 were observed to find out that the quantity of the adhesive agent 101 that had gotten into a liquid supply port 105 was substantially the same for all the liquid supply ports 105.

As described above, with this embodiment, the aperture sizes of the liquid supply ports 105 that are partly closed by the adhesive agent 101 are substantially the same for all the liquid supply ports 105. Ink supply amount can be substantially constant at each of the liquid supply ports 105. Thus, assuming that the adhesive agent 101 gets into the liquid supply ports 105, the amount by which the adhesive agent 101 gets into each of the liquid supply ports 105 can be controlled by arranging recesses 106 at predetermined respective positions. Therefore, the variation in the size of the liquid supply ports 105 that is produced as a result of the phenomenon that the adhesive agent 101 gets into the liquid supply ports 105 can be suppressed.

While the adhesive agent 101 is transferred and applied by the roller 100 in the above description, the liquid that is to be transferred and applied is not limited to adhesive agent 101 and the present invention is applicable to any liquids including encapsulant materials and primers.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-274412, filed Dec. 15, 2011, which is hereby incorporated by reference herein in its entirety.

What is claimed is:

1. A method of manufacturing a liquid ejection head, comprising:

a step of preparing a support substrate provided with a plurality of liquid supply ports for supplying liquid and a plurality of recesses or through-holes in a main surface thereof, the plurality of liquid supply ports being arranged in a zigzag arrangement on the main surface;

a step of transferring an adhesive agent onto the main surface by effecting relative movement between the support substrate and a roller holding the adhesive agent so as to make the recess or through-hole face the roller before the liquid supply port faces the roller; and a step of bonding, using the adhesive agent, the support substrate and a plurality of recording element substrates having energy generating elements for ejecting liquid, wherein the dimension of the recess or through-hole is greater than the dimension of the liquid supply port in a direction orthogonal to the direction of the relative movement between the roller and the support substrate.

2. The method according to claim 1, wherein a plurality of liquid supply ports are formed in the main surface and a recess or through-hole is formed between any two adjacently arranged liquid supply ports as viewed in the direction of the relative movement between the roller and the support substrate.

3. The method according to claim 1, wherein a first liquid supply port of the plurality of liquid supply ports, one of the recesses or through-holes and a second liquid supply port of the plurality of liquid supply ports are disposed in this order on the main surface such that a distance between the second liquid supply port and the one recess or through-hole is smaller than a distance between the first liquid supply port and the one recess or through-hole as viewed in the direction of the relative movement between the roller and the support substrate.

4. The method according to claim 1, wherein one of the plurality of recesses or through-holes precedes each of the plurality of liquid supply ports with respect to a direction of the relative movement between the support substrate and the roller, and the plurality of recording element substrates are arranged in a zigzag arrangement on the support substrate corresponding to the plurality of liquid supply ports arranged in the zigzag arrangement.

* * * * *